US007646877B2

(12) United States Patent
Akino

(10) Patent No.: US 7,646,877 B2
(45) Date of Patent: Jan. 12, 2010

(54) CONDENSER MICROPHONE

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 843 days.

(21) Appl. No.: 11/167,123

(22) Filed: Jun. 28, 2005

(65) Prior Publication Data

US 2006/0013428 A1 Jan. 19, 2006

(30) Foreign Application Priority Data

Jun. 30, 2004 (JP) ..... 2004-193410

(51) Int. Cl.
*H04R 25/00* (2006.01)
*H04R 9/08* (2006.01)

(52) U.S. Cl. ..... 381/174; 381/355

(58) Field of Classification Search ..... 381/113, 381/174, 355, 363, 366; 439/321
See application file for complete search history.

(56) References Cited

U.S. PATENT DOCUMENTS 4,355,213 A * 10/1982 Marsh ..... 381/363
2004/0198087 A1* 10/2004 Lin ..... 439/321

FOREIGN PATENT DOCUMENTS

JP H09-229292 A 9/1997

* cited by examiner

*Primary Examiner*—Brian Ensey
*Assistant Examiner*—Sunita Joshi
(74) *Attorney, Agent, or Firm*—Manabu Kanesaka

(57) ABSTRACT

In a condenser microphone including a microphone unit and an output module section which are connected to each other via a microphone cord, the length of a microphone cord in the output module section is shortened without interfering with soldering of the microphone cord to a circuit board of the output module section, so that noise caused by electromagnetic waves is prevented. In a condenser microphone where a condenser microphone unit 10 and an output module section 20, in which a circuit board 22 is housed in a shield case 21, are connected to each other via a microphone cord 30, a connection metal part 110 of the microphone cord and an output connector 23 are fixed to the circuit board 22 which can be inserted and removed in and from the shield case 21, the connection metal part 110 being detachably fit into an end opening 21*a* of the shield case 21. The connection metal part 110 of the microphone cord can be removed from the shield case 21 together with the circuit board 22.

3 Claims, 6 Drawing Sheets

CONDENSER MICROPHONE

TECHNICAL FIELD

The present invention relates to a condenser microphone in which a condenser microphone unit and an output module section are connected to each other via a dedicated microphone cord, and more specifically, to a technique for preventing high-frequency current from being generated by external electromagnetic waves in the output module section.

BACKGROUND ART

Various kinds of condenser microphones are available for various application purposes. The condenser microphones include a tie pin microphone attached to clothes or the like and a gooseneck microphone which is mainly used for conferences and disclosed in Patent Document 1 (Japanese Patent Application Publication No. H09-229292).

FIGS. 4 and 5 show conventional examples 1 and 2 of a tie pin microphone. FIG. 6 shows conventional example 3 of a gooseneck microphone. Of these drawings, FIGS. 4A and 5A are exploded views showing that an output module section is being assembled. FIGS. 4B and 5B are sectional views showing the completion of the assembly of the output module section.

In such tie pin and gooseneck condenser microphones, in order to make microphones inconspicuous, a condenser microphone unit 10 and an output module section 20 are separated from each other and are connected via a dedicated microphone cord 30.

Of the condenser microphone unit 10 and the output module section 20 which are shared among conventional examples 1 to 3, the condenser microphone unit 10 comprises a cartridge case 11 made of, e.g., aluminum. The cartridge case 11 acts as a shield case and houses a condenser unit including a diaphragm and a fixed pole (not shown) and an impedance converter. Generally, the impedance converter is an FET (field-effect transistor).

The output module section 20 comprises a cylindrical shield case 21 made of, e.g., a brass alloy. A circuit board 22 and an output connector 23 are housed in the shield case 21. A voice output circuit (not shown) including a transformer, a lowcut filter circuit, and an amplifier circuit, etc. is mounted on the circuit board 22.

The output connector 23 is fixed to one end of the circuit board 22 by screwing or the like and is disposed on the rear end of the shield case 21 when the circuit board 22 is housed in the shield case 21. The output module section 20 is called a power module section in some cases.

Generally, the output connector 23 in the condenser microphone is a 3-pin output connector defined by EIAJ RC5236 "a latch-lock round connector for sound." To be specific, the output connector 23 comprises a first pin for grounding (shielding), a second pin used as the hot side of a signal, and a third pin used as the cold side of a signal. The output connector 23 is connected to a phantom power source via a balanced shield cable (not shown).

The microphone cord 30 is a twin-core shield covered wire (not specifically shown) which includes a power wire for supplying power to the condenser microphone unit 10, a signal line for transmitting a voice signal outputted from the impedance converter to the voice output circuit of the circuit board 22, and a shield covered wire for electrostatically shielding the power wire and the signal line and grounding the power wire and the signal line.

The shield covered wire of the microphone cord 30 is connected, on the side of the condenser microphone unit 10, to the cartridge case 11 and is connected, on the signal input side of the output module section 20, to a ground circuit (not shown) of the shield case 21 and the circuit board 22. The first grounding pin of the output connector 23 is connected, on the signal output side of the output module section 20, to the ground circuit of the shield case 21 and the circuit board 22 in a manner similar to the shield covered wire.

In conventional example 1 shown in FIG. 4, when the microphone cord 30 is connected to the circuit board 22 of the output module section 20, the microphone cord 30 is passed through the shield case 21 and soldered to the circuit board 22 while the circuit board 22 is drawn from the shield case 21 as shown in FIG. 4A. A knot 31 for preventing disconnection is tied at one end of the microphone cord 30.

Thereafter, as shown in FIG. 4B, the circuit board 22 is housed in the shield case 21 together with the output connector 23. In conventional example 1, a rubber bush 24 acting as a catch of the knot 31 is provided on the front end of the shield case 21.

In conventional example 2 shown in FIG. 5, a cord connector 40 is used to connect a microphone cord 30 and a circuit board 22 of an output module section 20. To be specific, one of connector members included in the cord connector 40, for example, a male connector member 41 is provided on the side of the microphone cord 30 and a female connector member 42 serving as the other connector member is mounted on the front end of a shield case 21. The female connector member 42 and the circuit board 22 are connected to each other via an internal cord 32.

As shown in FIG. 5A, in an actual connecting operation, one end of the internal cord 32 is connected to the female connector member 42, the female connector member 42 is attached to the front end of the shield case 21, and the other end of the internal cord 32 is drawn from the shield case 21 and soldered to the circuit board 22. Thereafter, as shown in FIG. 5B, the circuit board 22 is housed in the shield case 21 together with the output connector 23.

Conventional example 3 shown in FIG. 6 describes a gooseneck microphone where a condenser microphone unit 10 is supported by a flexible pipe 50. In this case, an end fitting 25 for fitting and fixing the flexible pipe 50 is provided on the front end of a shield case 21. A microphone cord 30 is routed into the flexible pipe 50 and drawn from the fixed end of the flexible pipe 50. A cord insertion hole 25*a* for inserting the microphone cord 30 into the shield case 21 is bored in the end fitting 25.

In conventional example 3, when the microphone cord 30 is connected to a circuit board 22 of an output module section 20, the fixed end of the flexible pipe 50 is, for example, press-fit and fixed into the end fitting 25 while the microphone cord 30 is inserted into the shield case 21 through the cord insertion hole 25*a* of the end fitting 25 as shown in FIG. 6A, and the microphone cord 30 is soldered to the circuit board 22 outside the shield case 21. Thereafter, as shown in FIG. 6B, the circuit board 22 is housed in the shield case 21 together with an output connector 23.

Incidentally, when strong electromagnetic waves are applied to the microphone cord 30, high-frequency current caused by the electromagnetic waves may enter the shield case 21, the high-frequency current may be detected by a voice output circuit formed on the circuit board 22, and noise may occur.

Cellular phones have rapidly become widespread in recent years. When a cellular phone is used near a microphone, extremely strong electromagnetic waves are received (for example, in a range of about several cm to several tens cm, an electric field is several tens of thousands times as strong as an electric field generated by commercial radio waves). Thus, the provision of solutions to cellular phones is an urgent necessity in the field of microphones.

Particularly when the microphone cord 30 has a long wire length in the output module section 20, a part having the long wire length acts as an antenna and thus is susceptible to influences of electromagnetic waves. Therefore, when considering measures against electromagnetic waves, it is more preferable that the microphone cord 30 have a shorter wire length in the output module section 20. However, in conventional example 1, the knot 31 for preventing disconnection has to be tied on the microphone cord 30, resulting in a long wire length in the output module section 20.

Further, in conventional examples 2 and 3, the internal cord 32 of conventional example 2 is included in the microphone cord 30, and the circuit board 22 has to be drawn out of the shield case 21 when the microphone cord 30 is soldered to the circuit board 22 and during maintenance (repair). Thus, the microphone cord 30 in the output module section 20 has to have a wire length equal to or longer than the shaft length of the shield case 21. Therefore, in the condenser microphones of conventional examples 1 to 3, particularly noise caused by electromagnetic waves is a serious problem.

SUMMARY OF THE INVENTION

An object of the present invention is to shorten the length of a microphone cord in an output module section without interfering with soldering of the microphone cord to a circuit board and maintenance on the circuit board included in the output module section, in a condenser microphone where a condenser microphone unit and the output module section are connected to each other via a dedicated microphone cord.

In order to attain the object, the present invention provides a condenser microphone comprising a condenser microphone unit including an impedance converter and an output module section in which a circuit board including a voice output circuit is housed in a shield case and an output connector is attached to the rear end of the shield case, the condenser microphone unit and the output module section being connected to each other via a microphone cord, wherein the output connector is attached to one end of the circuit board, the microphone cord has a connection metal part integrally attached to the other end of the circuit board, the connection metal part being detachably fit into the end opening of the shield case, and the circuit board including the output connector and the connection metal part can be inserted and removed from the shield case.

According to a preferred first aspect of the present invention, the connection metal part comprises a cord insertion hole for drawing the microphone cord to the circuit board, and cord fixing means for fixing the microphone cord to be inserted into the cord insertion hole. This configuration is applied to a tie pin microphone. In this case, it is preferable that the cord fixing means be composed of a plastically deformable sleeve which is coaxial to the cord insertion hole and is integrally formed on the connection metal part.

According to a second preferred aspect of the present invention, when the microphone cord is connected to the output module section via a cord connector, one of connector members included in the cord connector is held on the connection metal part. This configuration is applied to a tie pin microphone.

According to a third preferred aspect of the present invention, the connection metal part comprises a cord insertion hole for drawing the microphone cord to the circuit board and an end fitting for fitting and fixing one end of a flexible pipe. This configuration is applied to a gooseneck microphone.

With this configuration, the connection metal part is attached to the circuit board and the connection metal part can be inserted and removed from the shield case together with the circuit board. Thus, the microphone cord in the output module section only requires a length for soldering, so that noise caused by electromagnetic waves can be effectively prevented. Further, this configuration does not interfere with soldering of the microphone cord to the circuit board or maintenance.

DETAILED DESCRIPTION

Figure 5A:
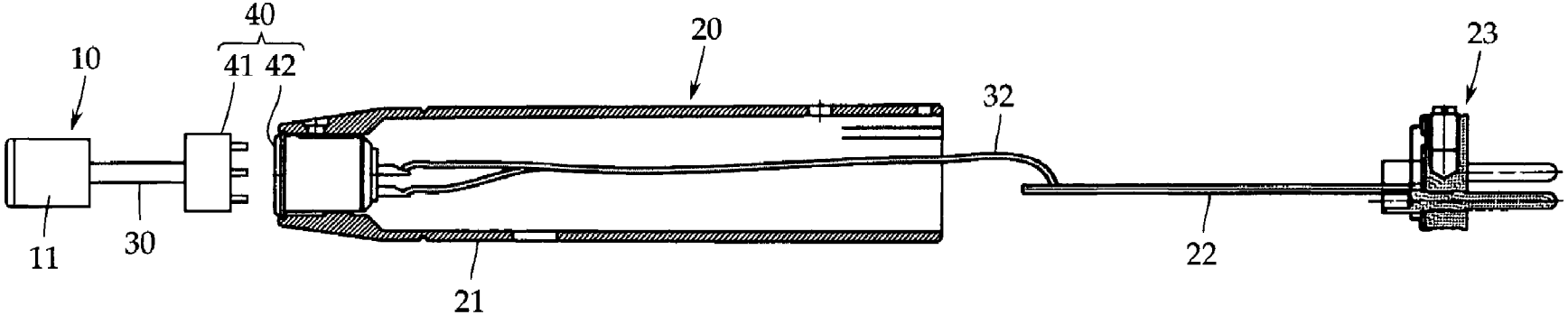
PRIOR ART FIG. 5A
FIG. 5A is an exploded view showing an output module section of conventional example 2.
Figure 5B:
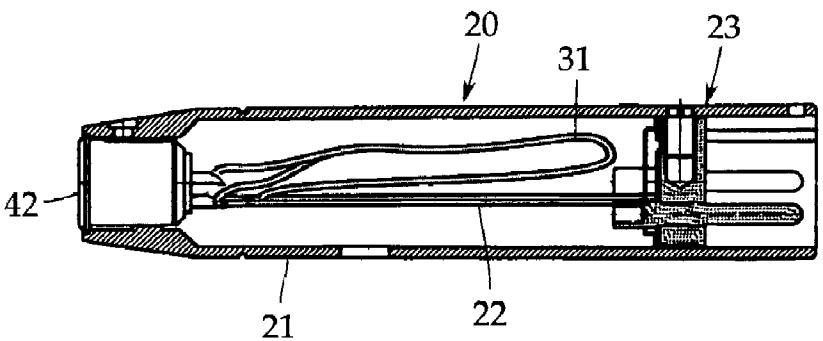
PRIOR ART FIG. 5B
FIG. 5B is a sectional view showing the completion of the assembly of the output module section.
Figure 6A:
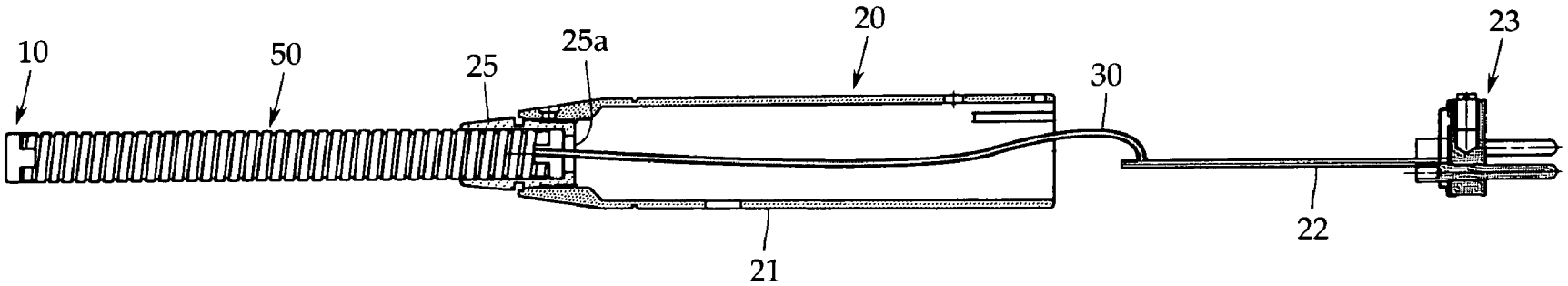
PRIOR ART FIG. 6A
FIG. 6A is an exploded view showing an output module section of conventional example 3.
Figure 6B:
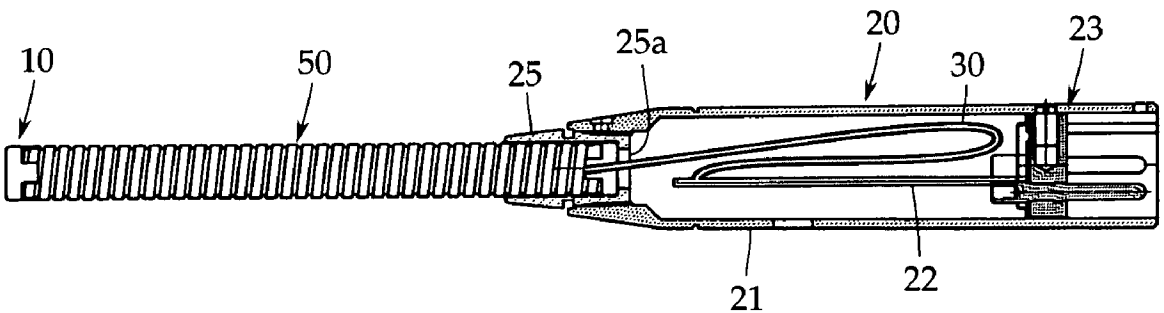
PRIOR ART FIG. 6B
FIG. 6B is a sectional view showing the completion of the assembly of the output module section.

Referring to FIGS. 1 to 3, embodiments of the present invention will be discussed below. The present invention is not limited to these embodiments. FIGS. 1 and 2 show Embodiments 1 and 2 of a tie pin microphone and correspond to the foregoing conventional examples 1 and 2 shown in FIGS. 4 and 5. FIG. 3 shows Embodiment 3 of a gooseneck microphone and corresponds to the foregoing conventional example 3 shown in FIG. 6.

In the explanation of Embodiments 1 to 3, constituent elements not to be particularly changed from conventional examples 1 to 3 are indicated by the same reference numerals. FIGS. 1A to 3A are exploded views showing that an output module section is being assembled. FIGS. 1B to 3B are sectional views showing the completion of the assembly of the output module section.

Figure 4A:
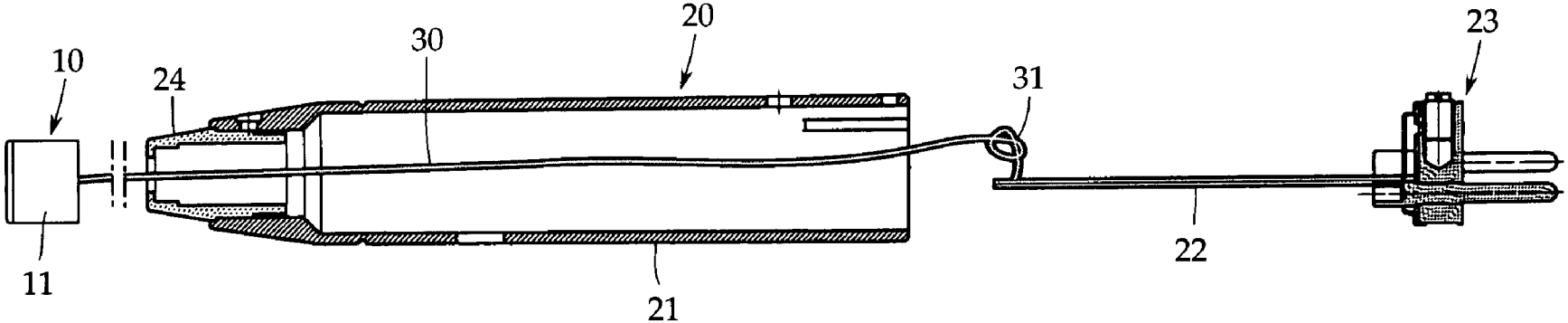
PRIOR ART FIG. 4A
FIG. 4A is an exploded view showing an output module section of conventional example 1.
Figure 4B:
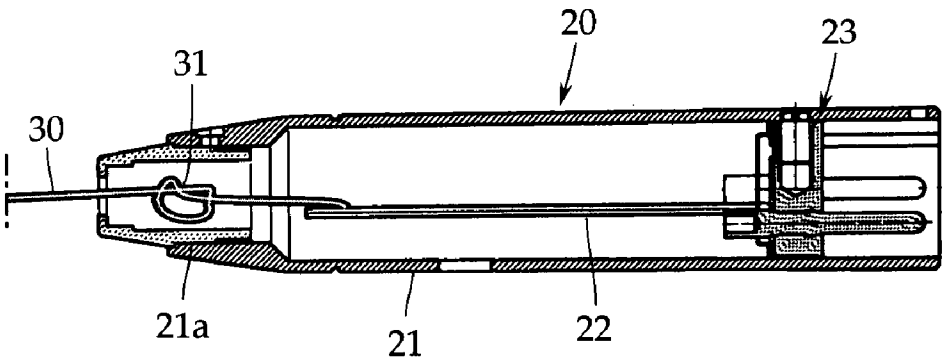
PRIOR ART FIG. 4B
FIG. 4B is a sectional view showing the completion of the assembly of the output module section.

In Embodiment 1 of FIG. 1, a condenser microphone is a tie pin microphone similar to conventional example 1 of FIG. 4, in which the condenser microphone unit 10 and the output module section 20 are connected to each other via the microphone cord 30. Unlike conventional example 1, Embodiment 1 comprises a connection metal part 110 for connecting a microphone cord 30 to a circuit board 22 in an output module section 20.

The connection metal part 110 is composed of a metal cylinder which is detachably fit into an end opening 21*a* of a shield case 21 included in the output module section 20, and a cord insertion hole 111 for the microphone cord 30 is provided at the center of the connection metal part 110. In order to prevent electromagnetic waves from entering the output module section 20, the connection metal part 110 is preferably fabricated with accuracy so as to be fit into the end opening 21*a* with almost no gap.

Further, as cord fixing means for the microphone cord 30, a plastically deformable sleeve 112 which is coaxial to the cord insertion hole 111 is integrally formed on the connection metal part 110. The sleeve 112 protrudes to the front of the connection metal part 110. A screw and a washer may be used as other examples of the cord fixing means.

Like conventional example 1, an output connector 23 is fixed to one end of the circuit board 22 by using screws or the like. In Embodiment 1, the connection metal part 110 is fixed to the other end of the circuit board 22 (the front end of the shield case 21) and can be inserted and removed to and from the shield case 21 together with the circuit board 22.

The connection metal part 110 has two tapped holes 113 and 114 which are bored in the radial direction. Of these tapped holes, the tapped hole 113 is used to screw the connection metal part 110 to the circuit board 22. The other tapped hole 114 is used to fix the connection metal part 110 to the shield case 21. A rubber bush 24 is attached to the front of the connection metal part 110.

Figure 1A:
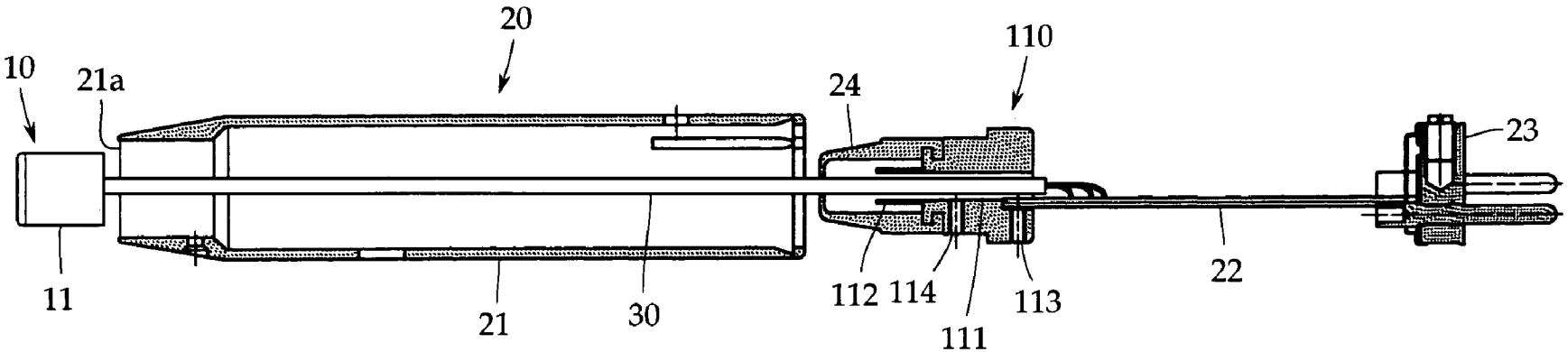
FIG. 1A is an exploded view showing an output module section according to Example 1 of the present invention.

In Embodiment 1, when the microphone cord 30 is connected to the circuit board 22 of the output module section 20, as shown in FIG. 1A, the circuit board 22 is drawn from the shield case 21, the microphone cord 30 is passed through the shield case 21 and the cord insertion hole 111 of the connection metal part 110, and one end of the microphone cord 30 is drawn onto the circuit board 22 and soldered thereon.

At this point, the robber bush 24 is removed and the sleeve 112 is swaged to fix the microphone cord 30 to the connection metal part 110. Therefore, unlike conventional example 1, it is not necessary to tie a knot 31 on the microphone cord 30. When the sleeve 112 is swaged, it is preferable to electrically connect the connection metal part 110 and the microphone cord 30 by removing a part of the swaged sheath of the microphone cord 30 to expose a shield.

Figure 1B:
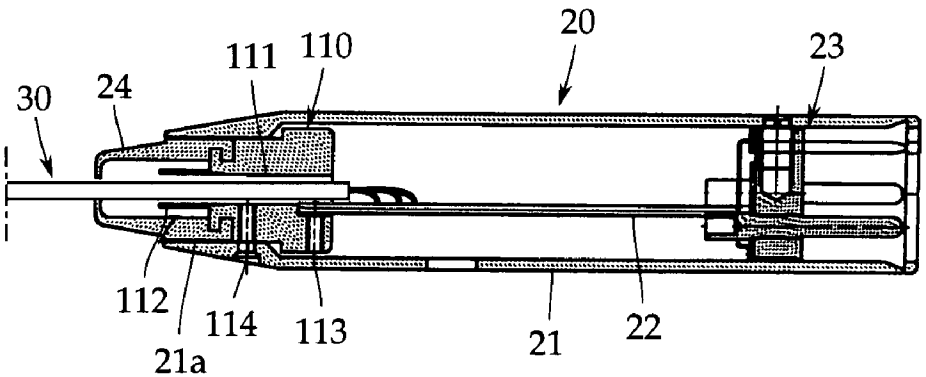
FIG. 1B is a sectional view showing the completion of the assembly of the output module section.

After soldering, as shown in FIG. 1B, the circuit board 22 is housed in the shield case 21, and the connection metal part 110 and the output connector 23 are screwed to the shield case 21 while the connection metal part 110 is fit into the end opening 21*a* of the shield case 21. According to Embodiment 1, the microphone cord in the output module section 20 only requires a length for soldering. Further, maintenance can be easily performed.

Embodiment 2 shown in FIG. 2 will now be discussed. A condenser microphone of Embodiment 2 is a tie pin microphone similar to the foregoing conventional example 2 of FIG. 5, in which the cord connector 40 is used to connect the microphone cord 30 and the circuit board 22 of the output module section 20. Such a cord connector 40 for a microphone is, for example, TB3M of Switchcraft, Inc.

Also in Embodiment 2, one of connector members included in a cord connector 40, for example, a male connector member 41 is connected to a microphone cord 30, and the other female connector member 42 is provided on an output module section 20. Embodiment 2 is different from foregoing conventional example 2 in that the female connector member 42 is fixed to a circuit board 22 via a connection metal part 120.

The connection metal part 120 is made of a metal and integrally comprises a cylindrical part 121 for holding the female connector member 42 and a base part 122 disposed on one end (rear end) of the cylindrical part 121. The cylindrical part 121 is detachably fit into an end opening 21*a* of a shield case 21.

When the male connector member 41 is provided on the side of the output module section 20, the male connector member 41 is held in the cylindrical part 121. In either case, in order to prevent electromagnetic waves from entering the output module section 20, the cylindrical part 121 is preferably fabricated with accuracy so as to be inserted into the end opening 21*a* of the shield case 21 with almost no gap.

The female connector member 42 is connected to the circuit board 22 through three lead wires 43 instead of the internal cord 32 of foregoing conventional example 2. An insertion hole 123 for inserting the three lead wires 43 is formed at the center of the base part 122. The internal cord 32 may be cut and used instead of the three lead wires 43.

A tapped hole 124 is bored on the base part 122 along the radial direction. The connection metal part 120 is fixed to the circuit board 22 through the tapped hole 124. Like the connection metal part 110 of foregoing Embodiment 1, a position where the connection metal part 120 is fixed on the circuit board 22 is on a side facing the output connector 23. A tapped hole 125 on the cylindrical part 121 is formed for fixation to the shield case 21.

Figure 2A:
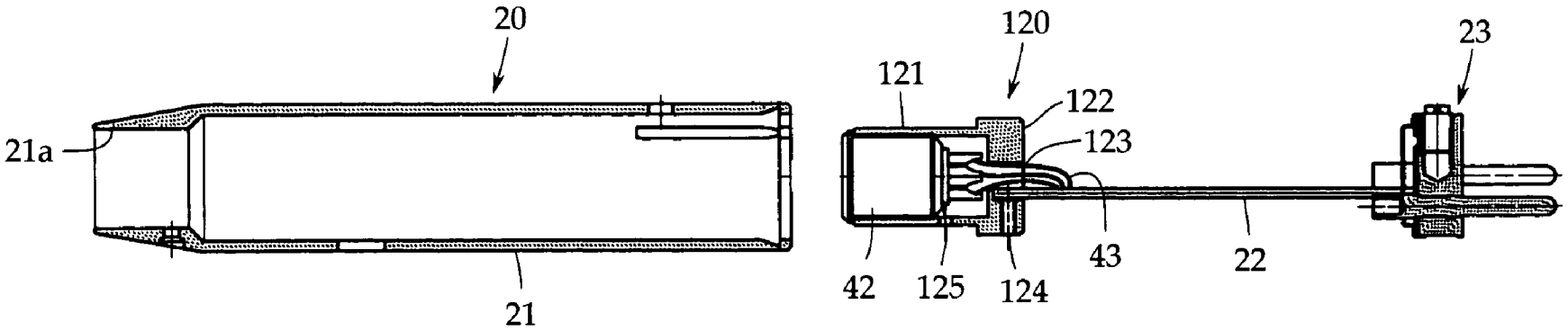
FIG. 2A is an exploded view showing an output module section according to Example 2 of the present invention.

According to Embodiment 2, as shown in FIG. 2A, the female connector member 42 where the lead wires 43 have been connected is fit into the cylindrical part 121 of the connection metal part 120, and the lead wires 43 are drawn from the insertion hole 123 onto the circuit board 22 and soldered thereon.

Figure 2B:
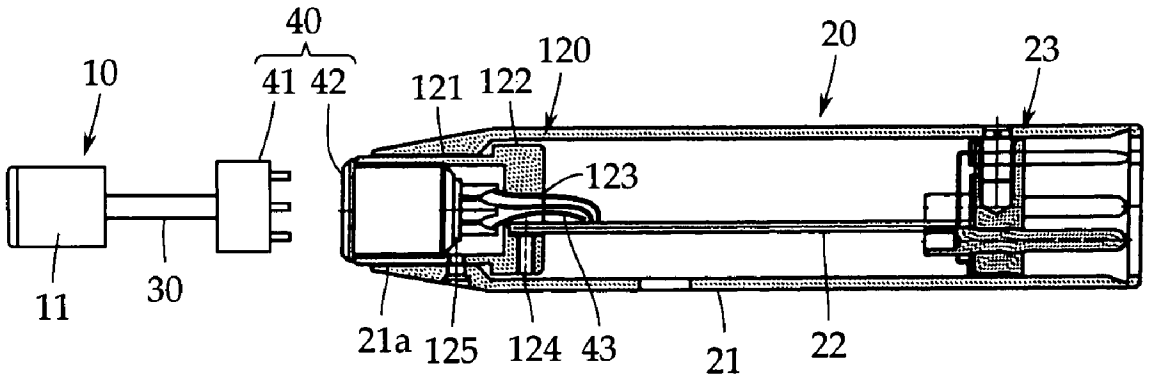
FIG. 2B is a sectional view showing the completion of the assembly of the output module section.

Then, as shown in FIG. 2B, the circuit board 22 is housed in the shield case 21, the connection metal part 120 and the output connector 23 are screwed to the shield case 21 while the connection metal part 120 is fit into the end opening 21*a* of the shield case 21, so that assembly is completed.

In this way, in Embodiment 2, the lead wires 43 in the output module section 20 only require a length for soldering as in Embodiment 1. Further, maintenance can be easily performed.

Embodiment 3 shown in FIG. 3 will now be discussed. A condenser microphone of Embodiment 3 is a gooseneck microphone similar to the foregoing conventional example 3 of FIG. 6, in which the condenser microphone unit 10 is supported by the flexible pipe 50. Embodiment 3 is different from foregoing conventional example 3 in that a connection metal part 130 for a flexible pipe 50 is provided on the side of a circuit board 22.

The connection metal part 130 is composed of a metal cylinder which is detachably fit into an end opening 21*a* of a shield case 21. An end fitting 131 for fitting the fixed end of the flexible pipe 50 is provided integrally on the connection metal part 130. Further, a cord insertion hole 132 for a microphone cord 30 is bored at the center of the connection metal part 130. In order to prevent electromagnetic waves from entering an output module section 20, the end fitting 131 is preferably fabricated with accuracy so as to be fit into the end opening 21*a* with almost no gap.

Two tapped holes 133 and 134 are bored on the connection metal part 130 along the radial direction. The tapped hole 133 is used to fix the connection metal part 130 to the circuit board 22. Like the connection metal parts 110 and 120 of Embodiments 1 and 2, a position where the connection metal part 130 is fixed on the circuit board 22 is on a side facing the output connector 23. The other tapped hole 134 is used for fixation to the shield case 21.

Figure 3A:
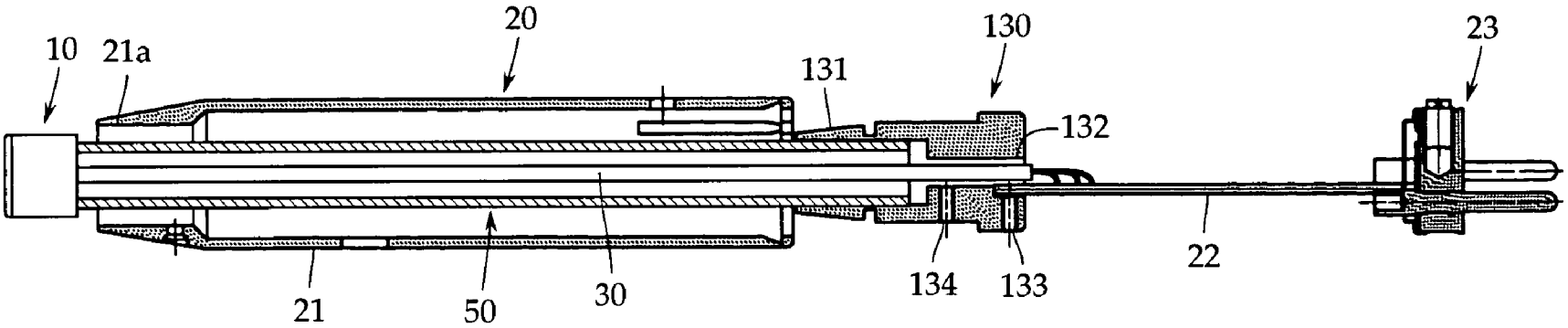
FIG. 3A is an exploded view showing an output module section according to Example 3 of the present invention.

In Embodiment 3, when the microphone cord 30 is connected to the circuit board 22 of the output module section 20, the flexible pipe 50 is passed through the shield case 21 while the circuit board 22 is drawn from the shield case 21 as shown in FIG. 3A. Then, the fixed end of the flexible pipe 50 is fit and fixed into the end fitting 131 while the microphone cord 30 drawn from the flexible pipe 50 is inserted into the cord insertion hole 132.

Figure 3B:
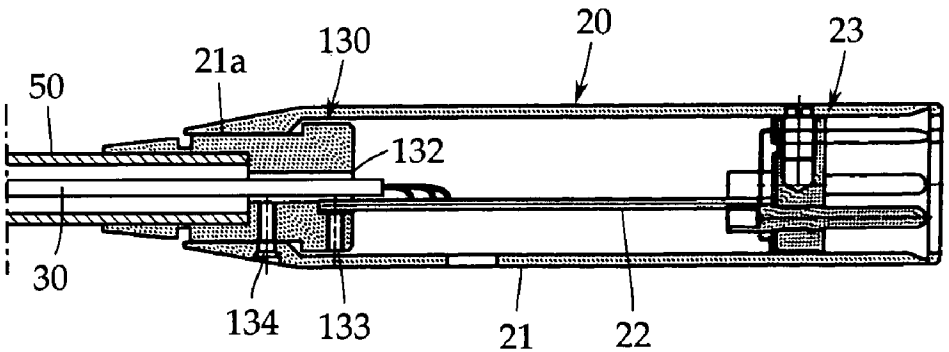
FIG. 3B is a sectional view showing the completion of the assembly of the output module section.

Thereafter, the end of the microphone cord 30 drawn onto the circuit board 22 from the cord insertion hole 132 is soldered on the circuit board 22. Then, as shown in FIG. 3B, the circuit board 22 is housed in the shield case 21, and the connection metal part 130 and the output connector 23 are screwed to the shield case 21 while the connection metal part 130 is fit into the end opening 21*a* of the shield case 21.

In this way, also in Embodiment 3, the microphone cord in the output module section 20 only requires a length for soldering. Therefore, it is possible to eliminate a part acting as an antenna in the output module section 20, so that high-frequency current caused by electromagnetic waves do not enter the output module section 20 and the noise is prevented. Even when the shield case 21 is removed, it is possible to confirm an operation of the microphone, thereby readily perform assembly and repair.

The present application is based on, and claims priority from, Japanese Application Serial Number JP2004-193410, filed Jun. 30, 2004, the disclosure of which is hereby incorporated by reference herein in its entirety.

The invention claimed is:

1. A condenser microphone, comprising:

a condenser microphone unit including an impedance converter, and an output module section in which a circuit board including a voice output circuit is housed in a shield case and an output connector is attached to a rear end of the shield case, the condenser microphone unit and the output module section being connected to each other via a microphone cord, wherein the output connector is attached to one end of the circuit board, the microphone cord has a connection metal part integrally attached to the other end of the circuit board, the connection metal part being detachably fit into an end opening of the shield case, and the circuit board including the output connector and the connection metal part is configured to be inserted and removed in and from the shield case;

the microphone cord does not substantially enter the shield case;

the connection metal part comprises a cord insertion hole for drawing the microphone cord to the circuit board, and cord fixing means for fixing the microphone cord to be inserted into the cord insertion hole; and the cord fixing means is composed of a plastically deformable sleeve which is coaxial to the cord insertion hole and is integrally formed on the connection metal part.

2. A condenser microphone, comprising:

a condenser microphone unit including an impedance converter, an output module section including a shield case, a circuit board situated in the shield case and having a voice output circuit, and an output connector connected to one end of the circuit board to be attached to a rear end of the shield case, a connection metal part integrally attached to the other end of the circuit board to be attached to a front end of the shield case so that the circuit board, the output connector and the connection metal are removably inserted in and from the shield case through the rear end of the shield case, and a microphone cord connected between the condenser microphone unit and the circuit board of the output module section through the connection metal part so that the microphone cord covered by the connection metal part is only disposed in the shield case when the circuit board, the output connector and the connection metal part are fitted into the shield case.

3. The condenser microphone according to claim 2, wherein said connection metal part includes a cord insertion hole through which said microphone cord passes.

* * * * *